US005146940A

United States Patent [19]

Hamada

[11] Patent Number: 5,146,940

[45] Date of Patent: Sep. 15, 1992

[54] UMBRELLA COVER COMPRISING EXTENSIBLE CYLINDRICAL ROLL

[76] Inventor: Fumio Hamada, 25-12, Tama-ku, Ikuta 6-chome, Kawasaki-shi, Kanagawa 214, Japan

[21] Appl. No.: 707,338

[22] Filed: May 29, 1991

[30] Foreign Application Priority Data

May 31, 1990 [JP] Japan ..... 2-142690

[51] Int. Cl.[5] ..... A45B 15/00

[52] U.S. Cl. ..... 135/34.2; 150/154; 224/915; 220/8

[58] Field of Search ..... 135/34.2, 48, 33.6; 150/154; 224/915; 220/8, 306; D3/5

[56] References Cited

U.S. PATENT DOCUMENTS

| | | | |
|---|---|---|---|
| 1,270,462 | 6/1918 | Thueringer | 220/8 |
| 1,289,269 | 12/1918 | Rucker | 135/34.2 |
| 2,742,913 | 4/1956 | Weisblatt | 135/34.2 |
| 3,285,459 | 11/1966 | Gahm | 220/8 |
| 3,338,474 | 8/1967 | Olson | 220/8 X |
| 3,471,058 | 10/1969 | Latham et al. | 220/8 X |
| 4,557,378 | 12/1985 | Klebold | 220/8 X |
| 4,940,138 | 7/1990 | Hornstein | 220/8 X |

FOREIGN PATENT DOCUMENTS

| | | | |
|---|---|---|---|
| 0413600 | 8/1910 | France | 135/34.2 |
| 468371 | 4/1914 | France | 135/34.2 |
| 57-27924 | 2/1982 | Japan . | |
| 59-21215 | 2/1984 | Japan . | |
| 60-120622 | 5/1985 | Japan . | |
| 2-126803 | 5/1990 | Japan . | |
| 23204 | of 1905 | United Kingdom | 224/915 |

*Primary Examiner*—David A. Scherbel
*Assistant Examiner*—Lan Mai
*Attorney, Agent, or Firm*—Oliff & Berridge

[57] ABSTRACT

An umbrella cover for covering a closed umbrella is provided. The umbrella cover comprises a cylindrical roll of a spirally wound strip which may be elongated by axially pulling out the outer end of the the wound strip. The inner end of the wound strip is secured to the ferrule of the umbrella. The strip has formed therein a plurality of parallel slits extending at a predetermined tilt angle in relation to the longitudinal axis of the strip, and a plurality lips which have a configuration capable of engaging with the slit. The strip is wound such that the lip in one turn of the spirally wound strip is engaged with the slit in the adjacent turn of the wound strip so that the lip can slide along the slit upon elongation of the cylindrical roll, and such an engagement of the lips in the slit prevents the wound strip from being excessively pulled out. The strip may comprise two overlaid film tapes each having the slits or the lips formed therein, or one film tape having the both.

6 Claims, 8 Drawing Sheets

UMBRELLA COVER COMPRISING EXTENSIBLE CYLINDRICAL ROLL

BACKGROUND OF THE INVENTION

1. Field of the Invention

This invention relates to an umbrella cover for covering the umbrella in its closed state. The umbrella cover is secured to the umbrella at its tip or ferrule, and comprises an extensible cylindrical roll of a spirally wound strip which may be pulled up to cover the outer peripheral surface of the umbrella.

2. Prior Art

Various umbrella covers have been recently proposed for covering a closed umbrella. Some of the covers are attached to the tip or the ferrule of the umbrella, and comprise an extensible cylindrical body. These umbrella covers may be packed up compactly when the umbrella is in use, namely, when the umbrella is open, and when the wet umbrella is closed, they may be elongated to cover the outer peripheral surface of the closed umbrella in cars, trains, shops, and the like. Typical such umbrella covers include Japanese Utility Model Application KOKAI Nos 60-120622 and 59-21215 wherein bellows system is utilized for their extension, and Japanese Utility Model Application KOKAI No. 57-27924 wherein a plurality of cylinders respectively having different diameters are nested to enable the extension.

The umbrella covers of the bellows system, since they are packed up in their folded state, suffer from aesthetic problem that creases remain in their elongated state. The umbrella covers of the nesting system suffer from water leakage through gaps between the adjacent cylinders, and are frequently stuck disenabling a smooth elongation.

In view of such situation, the inventor of the present invention proposed Japanese Patent Application No. 1-177360 (Japanese Patent Application KOKAI No. 2-1268035 directed to an umbrella cover comprising an extensible cylindrical roll of a spirally wound film tape, which is axially pulled out to form an elongated cylinder. More illustratively, the umbrella cover of this application comprises a spirally wound elongated film tape formed with a continuous engaging ridge on each of the opposite longitudinal edges of the film tape. The outer end portion of the spirally wound film tape is fixed to a ring member. When the ring member is moved along the winding axis of the spirally wound film tape, the film tape will be spirally pulled out until the engaging ridge on one longitudinal edge of one turn of the spirally wound film tape engages the engaging ridge on the other longitudinal edge of the adjacent turn of the spirally wound film tape to avoid an excessive pulling out of the spirally wound film tape. The inner end portion of the spirally wound film tape is secured to a supporting member, which in turn is secured to the umbrella at its ferrule. This application also discloses an embodiment wherein inner surfaces of adjacent turns of the spirally wound film tape are connected to one another with a string of a length slightly shorter than the width of the film tape in order to more reliably avoid the axially pulled out film tape from becoming loose and entangled.

The umbrella cover of this type can smoothly and easily cover the outer surface of the closed umbrella by merely pulling out the spirally wound film tape in its axial direction, and may be restored to its original non-elongated state by merely packing up the pulled out wound film tape. Also, such an umbrella cover is free of creases and has a simple appearance in its elongated state. Furthermore, the umbrella cover of this type does not suffer from water leakage problem since the gap between adjacent turns of the spirally wound film tapes would be reduced upon the elongation of the spirally wound film tape.

Although the umbrella cover proposed in Japanese Patent Application No. 1-177360, supra, has such advantages, it also suffers from the problems as described below.

The loosening of the spirally wound film tape upon its elongation is primarily prevented by providing the continuous engaging ridge on each of the opposite longitudinal edges of the film tape, which engage one another upon elongation of the spirally wound film tape to prevent the film tape to be excessibly pulled out. It is, however, practically difficult to prevent the loosening of the spirally wound film tape only by such engaging ridges, and the umbrella cover of the above-cited application attempts to more reliably avoid the loosening by further providing the strings which connect adjacent turns of the film tape. Provision of such strings are actually quite troublesome, and results in a significantly increased production cost. More illustratively, the strings have to be provided on the inner surface of the film tape to prevent the strings from being exposed on the outer surface of the elongated umbrella cover for aesthetic reason, and therefore, the provision of the strings should be carried out while the spirally wound film tape is pulled out at least to a certain degree. Such a process actually demands close attention as well as hand skill, and therefore, is quite difficult to adapt in actual production line.

SUMMARY OF THE INVENTION

The present invention has been completed in view of such a situation, and therefore, one object of the present invention is to further improve the extensible cylindrical roll used in the umbrella cover of Japanese Patent Application No. 1-177360, supra, and provide an umbrella cover utilizing an extensible cylindrical roll which does not become loose and entangled upon its elongation, and which may be produced at low cost.

Other objects and advantages of the present invention will be apparent from the following description taken in conjunction with the accompanying drawings.

According to the present invention, there is provided an umbrella cover comprising a cylindrical roll of a spirally wound strip which may be elongated by pulling out the wound strip along the axis of the cylindrical roll. The strip has formed therein a plurality of parallel slits extending at a predetermined tilt angle in relation to the longitudinal direction of the strip. The slits are formed at predetermined intervals. Also formed in the strip are a plurality lips which have a configuration capable of engaging with the slit. The lips are formed in the vicinity of one longitudinal edge of the strip at predetermined intervals. The strip is wound such that the lip in one turn of the spirally wound strip may be slidably engaged with the slit in the adjacent turn of the wound strip so that the lip can slide along the slit in its longitudinal direction upon elongation of the cylindrical roll.

The strip may preferably comprise at least two overlaid film tapes which are bonded with each other at least along their opposite longitudinal edges. In such a strip, the slits may be formed in the film tape on one surface of the strip, and the lips may be formed in the film tape on the other surface of the strip.

The strip may also comprise one film tape wherein both the slits and the lips formed.

In the umbrella cover according to the present invention, the inner end portion of the strip may be secured to a supporting member secured to the ferrule of the umbrella such that the axis of the extensible cylindrical roll coincides with the longitudinal axis of the umbrella, and the outer end portion of the strip may be secured to a ring member coaxially positioned with the umbrella. The inner end portion of the spirally wound strip is in contact with the outer surface of the supporting member, and the outer end portion of the wound strip is in contact with the inner surface of the ring member. The extensible cylindrical roll may be secured to the supporting member such that the inner end portion of the strip can pivot a predetermined small angle on the outer surface of the supporting member, and the ring member may be secured to the extensible cylindrical roll such that the outer end portion of the strip can pivot a predetermined small angle on the inner surface of said ring member.

In the extensible cylindrical roll of the umbrella cover according to the present invention, the slits are formed in the film tape at a predetermined angle in relation to the longitudinal direction of the strip, and the pair of lips in one turn of the spirally wound strip is in engagement with the slit in the adjacent turn of the spirally wound strip such that the pair of lips may slide along the slit in its longitudinal direction. Therefore, when the outer or inner end of the spirally wound strip is axially pulled out, the lips will slide along the slits in which they are engaged to enable the wound strip to be helically pulled out to increase the length of the cylindrical roll in its axial direction. The cylindrical roll is thereby elongated. When the lips reach the end of the slit, the lips engaged at the end of the slit will prevent the strip from being excessively pulled out. Since the adjacent turns of the wound strip remain overlapped on one another, the strip may be prevented from being excessively pulled out to become loose and entangled.

The slit may be formed by merely cutting out an elliptic hole in the film tape. The slit, therefore, may be formed with a press-cutting machine. The lip may also be formed by merely cutting or punching the contour of the lip. The lip, therefore, may also be formed with a press-cutting machine. Since the lips and the slits may be formed with a press machine, and at regular intervals, they may be quite easily and conveniently formed.

The strip may comprise one film tape having both the slits and lips formed therein. In such a case, however, the slits and the cuts defining the lips penetrate the thickness of the strip, and therefore, are not preferable in some applications. In such a case, the strip may be formed from two or more film tapes each having the slits or the lips formed therein. By bonding the film tapes such that the slits and lips do not overlap with each other, there would be no holes or cuts penetrating through the thickness of the strip.

In the umbrella cover of the present invention, the inner end portion of the above-described spirally wound strip is secured to a supporting member, which in turn is secured to the ferrule of the umbrella. The outer end portion of the spirally wound strip is secured to a ring member coaxially positioned with said umbrella. Since the ring member is not secured to the umbrella, the umbrella may be covered by moving the ring member toward the handle of the closed umbrella to pull out the spirally wound strip and elongate the cylindrical roll. When not in use, the umbrella cover may be packed up by bringing the ring member back to the ferrule of the umbrella.

PREFERRED EMBODIMENT

Figure 1:
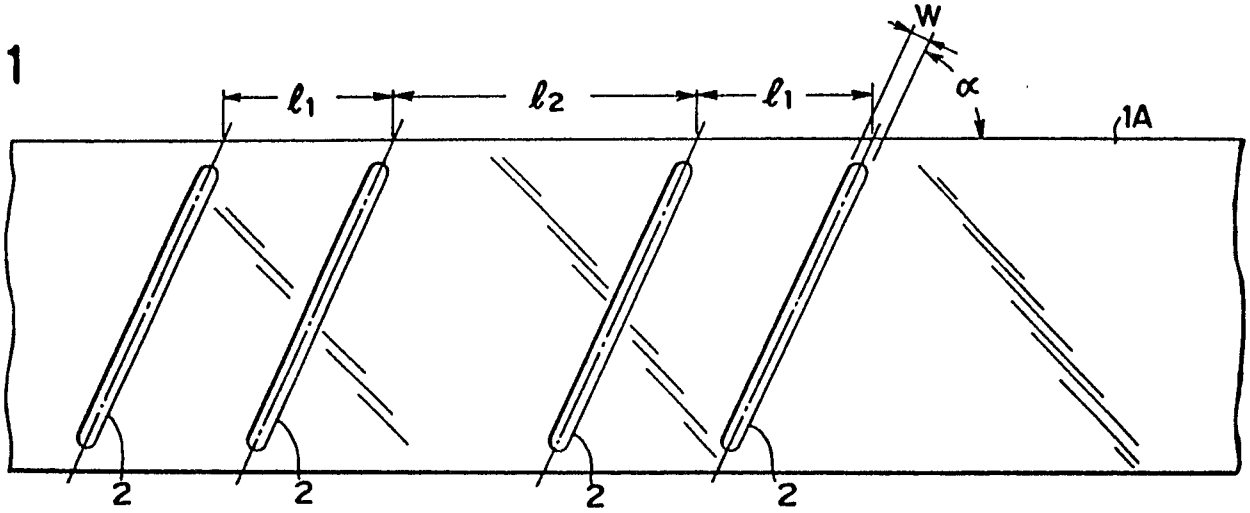
FIG. 1 is an enlarged partial plan view of one film tape of the strip according to an embodiment of the present invention wherein the strip constituting the extensible cylindrical roll of the umbrella cover comprises two overlaid film tapes.
Figure 2:
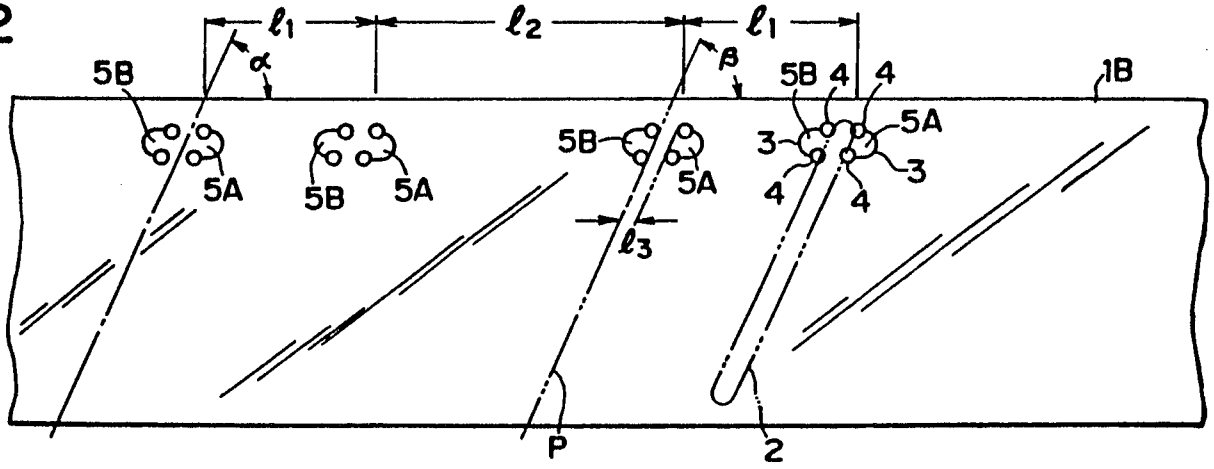
FIG. 2 is an enlarged partial plan view of the other film tape of the strip according to the embodiment illustrated in FIG. 1.

The present invention is hereinafter described in further detail with regard to an embodiment wherein the strip constituting the extensible cylindrical roll of the umbrella cover comprises two overlaid film tapes. Referring to FIG. 1, there is illustrated one film tape 1A of the two film tapes used for the strip. Referring to FIG. 2, there is illustrated the other film tape 1B of the two film tapes of the strip.

The film tape 1A may comprise a flexible synthetic resin film having a relatively good memory, for example, a polyester film. As shown in FIG. 1, the film tape 1A has a plurality of parallel elliptic slits 2 each having a width w formed therein. The slits 2 are arranged such that they may extend at a predetermined tilt angle $\alpha$ in relation to the longitudinal direction of the film tape 1A. The slits 2 are aligned in longitudinal direction of the film tape 1A at alternate intervals of $1_1$ and $1_2$.

The film tape 1B may also comprise a flexible synthetic film having properties similar to those of the film tape 1B. As shown in FIG. 2, a plurality of arc-shaped or U-shaped lips 5A and 5B are arranged in the vicinity of one longitudinal edge of the film tape 1B. The lips 5A and 5B are defined by an arc-shaped or U-shaped cut 3 and two small holes 4 located at opposite ends of the cut 3. The lips 5A or 5B are arranged such that a line P intersecting opposite ends of each of the lip may extend at an angle $\beta$ in relation to the longitudinal direction of the film tape 1B, the angle $\beta$being substantially equal to the angle $\alpha$ of the slit 2. Two adjacent lips 5A and 5B are arranged to face opposite directions from each other, and are formed at an interval $1_3$ slightly shorter than the width w of the slit 2. Such pairs of lips 5A and 5B are arranged to align in the vicinity of one longitudinal edge of the film tape 1B at alternate intervals $1_1$ and $1_2$ equivalent to those of the slits 2.

Figure 3:
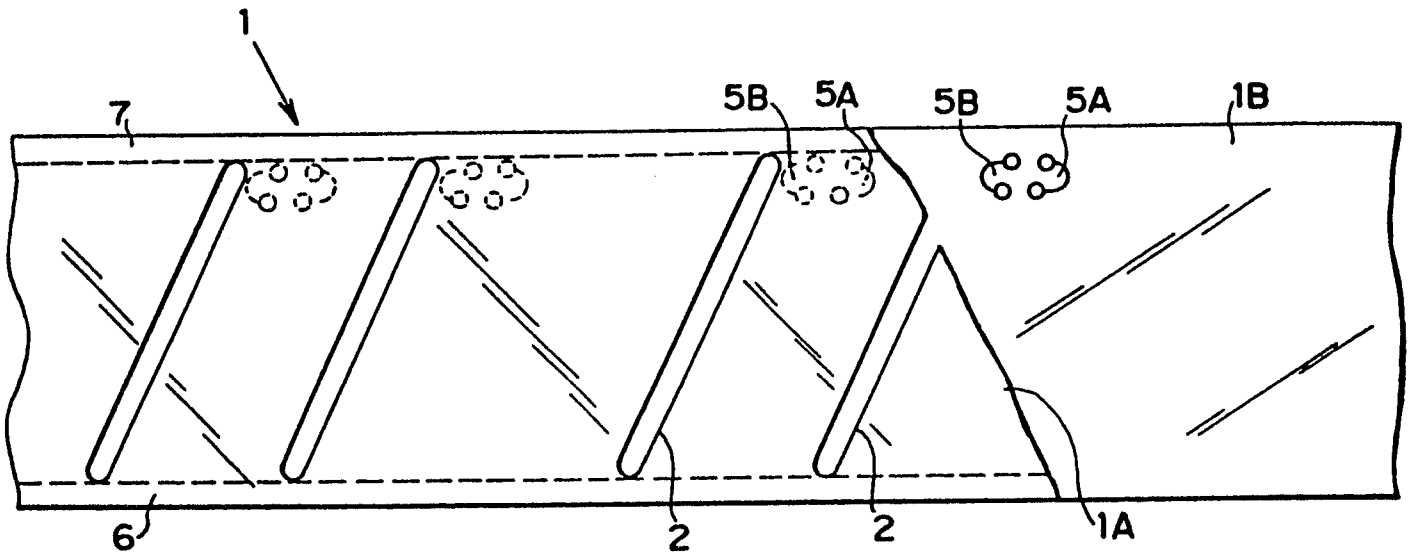
FIG. 3 is an enlarged partial plan view of the strip comprising the film tapes illustrated in FIGS. 1 and 2.

Referring to FIG. 3, there is illustrated a strip 1 comprising the above-described two film tapes 1A and 1B. The film tapes 1A and 1B are overlaid one above the other such that the slits 2 in the film tape 1A may not overlap with the pairs of lips 5A and 5B in the film tape 1B, and are bonded to each other along their opposite longitudinal edges 6 and 7 with an adhesive or by heat sealing.

Figure 4:
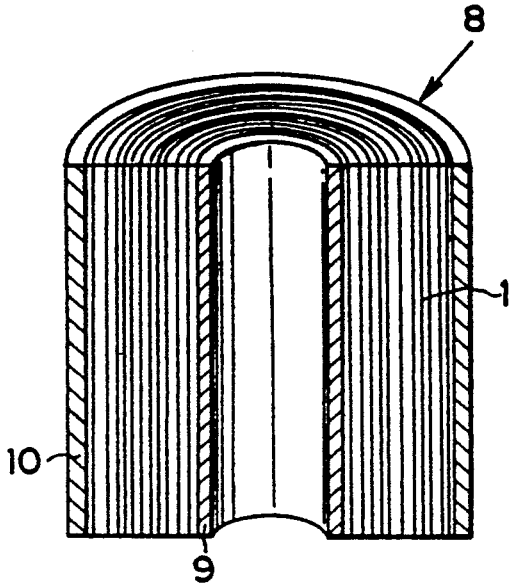
FIG. 4 is a vertically cut away perspective view of the extensible cylindrical roll of the umbrella cover according to an embodiment of the present invention.

Referring to FIG. 4, there is illustrated an embodiment of an extensible cylindrical roll 8 of the above-described strip 1. The extensible cylindrical roll 8 comprises the strip 1, which is spirally wound, and a ring-shaped supporting member 9 and a ring member 10 are secured to the spirally wound roll of the strip at its inner and outer end portions, respectively. The supporting member 9 may comprise, for example, a plastic resin. The inner end portion of the spirally wound strip 1 is secured to the supporting member 9 on its outer peripheral surface to allow for the inner end portion of the strip 1 to be pivoted a predetermined small angle on the outer peripheral surface of the support member 9. The ring member 10 may also comprise, for example, a plastic resin. The outer end portion of the spirally wound strip 1 is secured to the ring member 10 on its inner peripheral surface to allow for the outer end portion of the strip 1 to be pivoted a predetermined small angle on the inner peripheral surface of the ring member 10. The securing of the wound strip 1 to the supporting member 9 and the ring member 10 is described later in further detail by referring to FIGS. 7 to 10.

Figure 5:
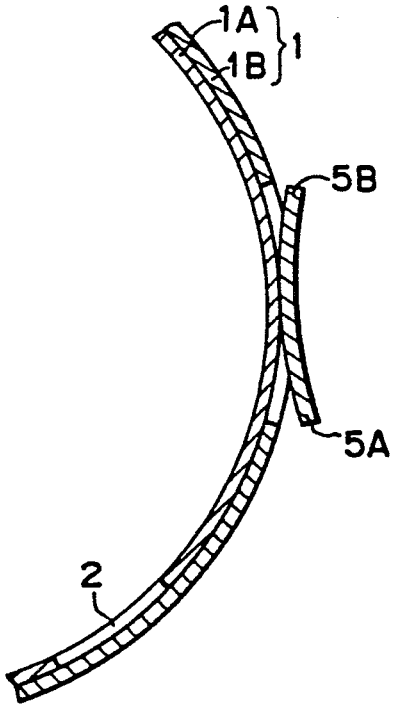
FIG. 5 is a transverse sectional view of one turn of the wound strip of the extensible cylindrical roll illustrated in FIG. 4, schematically showing the relationship between the slit, the lip, and the winding direction of the strip.
Figure 6:
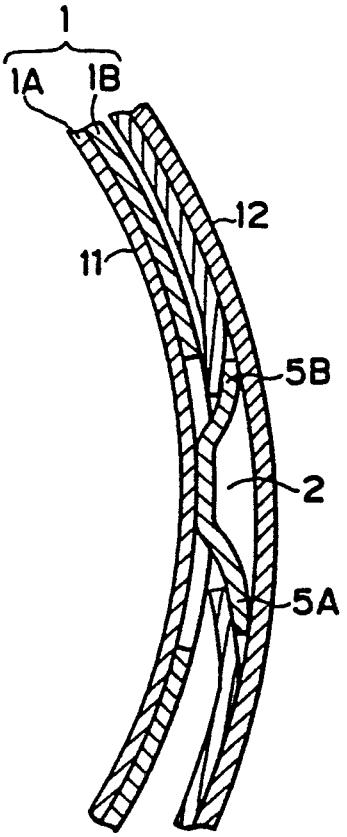
FIG. 6 is a transverse sectional view of two adjacent turns of the wound strip of the extensible cylindrical roll illustrated in FIG. 4 schematically showing the engagement between the slit of the outer turn and the lip of the inner turn.
Figure 7:
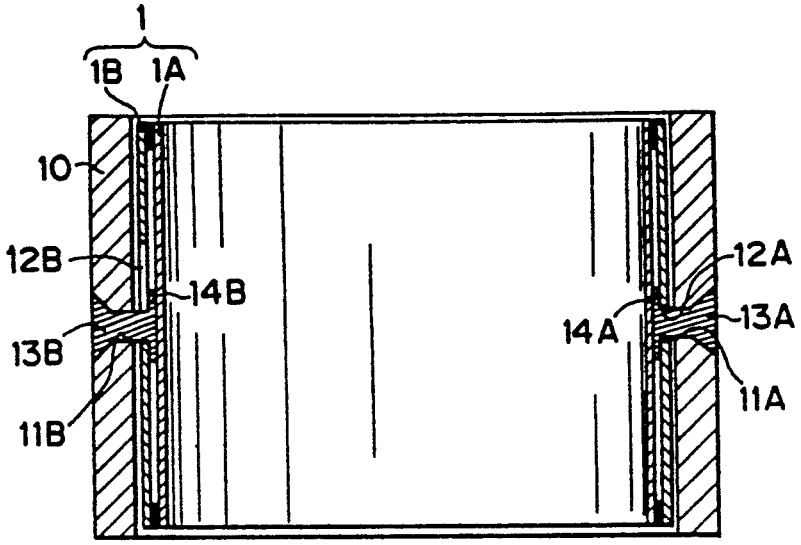
FIG. 7 is a vertical sectional view illustrating the outer end portion of the wound strip secured to the ring member.

As schematically shown in FIG. 5, the strip 1 is wound in such a direction that the film tape 1A having the slits 2 formed therein may be located on the inner side and the film tape 1B having the pairs of lips 5A and 5B may be located on the outer side. Referring to FIG. 6, there is schematically shown two adjacent turns 11 and 12 of the wound strip 1, namely, the inner turn 11 and the outer turn 12. The pair of lips 5A and 5B formed in the outer film tape 1B of the inner turn 11 of the strip 1 is engaged in the slit 2 formed in the inner film tape 1A of the outer turn 12 of the strip 1. It is to be noted that the pairs of the lips 5A and 5B are so positioned that, when the extensible cylindrical roll 8 is in its non-elongated packed up state, the lips 5A and 5B would be situated in the vicinity of one end of the slit 2.

Figure 11:
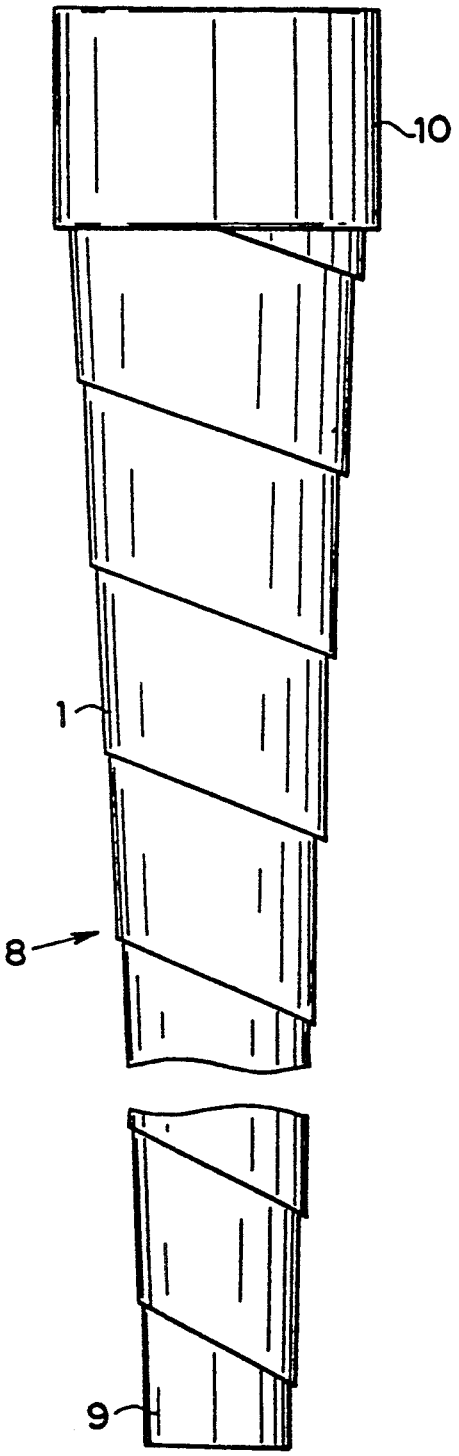
FIG. 11 is an elevational view illustrating the extensible roll of FIG. 4 in its extended state.

When the inner supporting member 9 is secured to the tip or the ferrule 21 of the umbrella, and the outer ring member 10 is pulled along the axis of the cylindrical roll 8 toward the handle 23 of the umbrella, the spirally wound strip 1 of the extensible cylindrical roll 8 will be spirally or helically pulled out as shown in FIG. 11. In the meanwhile, the pairs of lips 5A and 5B slide along slits 2, in which the the pairs of lips 5A and 5B are engaged, until they reach the other end of the slits 2 to prevent the strip 1 from being excessively pulled out.

As mentioned above, FIGS. 7 and 8 diagrammatically show the securing of the outer end portion of the strip 1 to the ring member 10. The ring member 10 has two through holes 11A and 11B at positions of point symmetry. The outer end portion of the strip 1 has a small hole 12A and a slit 12B formed in the outer film tape 1B of the two film tapes 1A and 1B constituting the strip 1 at positions corresponding to the two through holes 11A and 11B of the ring member 10. The slit 12B is formed to extend parallel with the aforementioned slits 2. A grommet or an eyelet 13A extends through the holes 11A and 12A, and a grommet or an eyelet 13B extends through the hole 11B and the slit 12B. The grommets or eyelets 13A and 13B have their inner dilated heads 14A and 14B respectively positioned between the inner film tape 1A and the outer film tape 1B.

Figure 9:
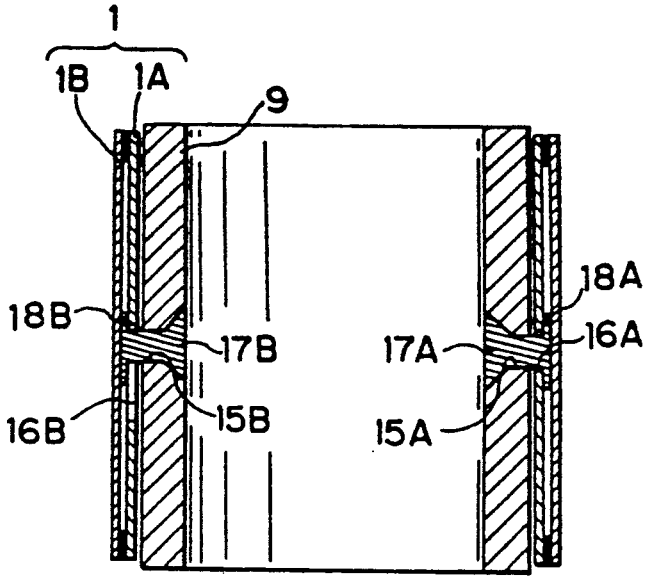
FIG. 9 is a vertical sectional view illustrating the inner end portion of the wound strip secured to the supporting member.
Figure 10:
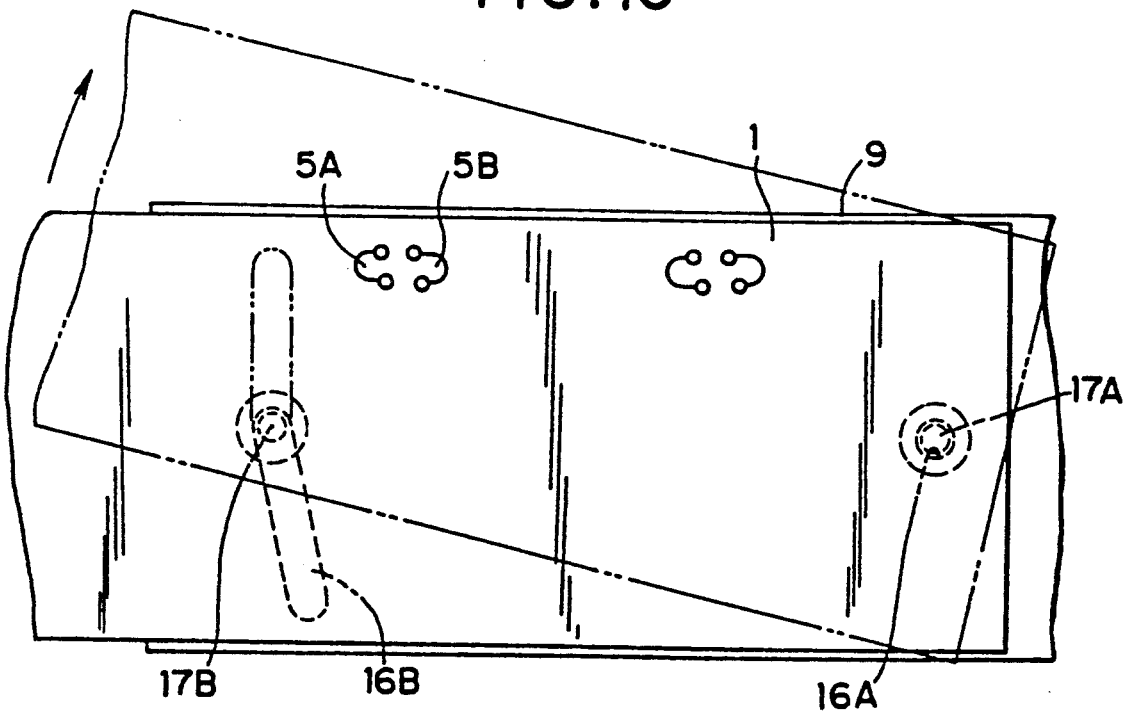
FIG. 10 is a development of the structure of FIG. 9 seen from outer side.

FIGS. 9 and 10 diagrammatically show the securing of the inner end portion of the strip 1 to the supporting member 9. The ring-shaped supporting member 9 has two through holes 15A and 15B at positions of point symmetry. The inner end portion of the strip 1 has a small hole 16A and a slit 16B formed in the outer film tape 1B of the two film tapes 1A and 1B constituting the strip 1 at positions corresponding to the two through holes 15A and 15B of the supporting member 9. The slit 16B is formed to extend parallel with the aforementioned slits 2. A grommet or an eyelet 17A extends through the holes 15A and 16A, and a grommet or an eyelet 17B extends through the hole 15B and the slit 16B. The grommets or eyelets 17A and 17B have their outer dilated heads 18A and 18B respectively positioned between the inner film tape 1A and the outer film tape 1B.

Figure 8:
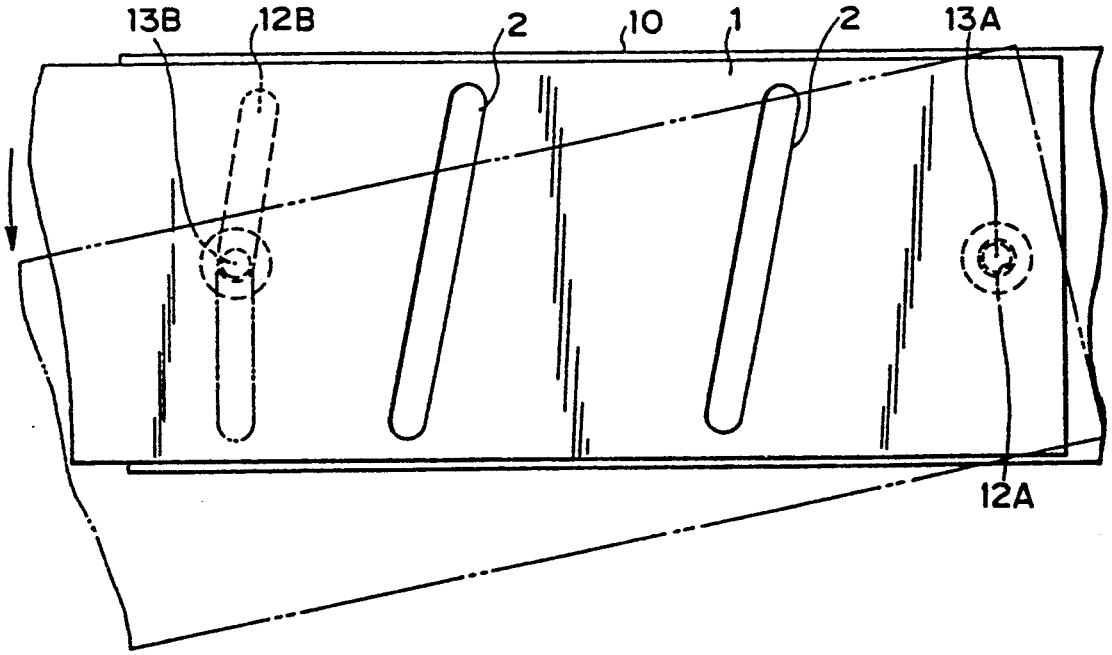
FIG. 8 is a development of the structure of FIG. 7 seen from inner side.

The inner and outer end portions of the strip 1 is secured to the supporting member 9 and the ring member 10 as described above. Consequently, as shown in FIG. 8, when the cylindrical roll 8 of the wound strip 1 is extended or elongated, the outer end portion of the strip 1 pivots a predetermined small angle on the inner peripheral surface of the ring member 10 around the the grommet or the eyelet 13A, which extends through the holes 11A and 12A. Such a pivoting of the outer end portion of the strip 1 is enabled by the slidable engagement of the grommet or the eyelet 13B along the slit 12B. Similarly, as shown in FIG. 10, upon the elongation of the cylindrical roll 8 of the wound strip 1, the inner end portion of the strip 1 pivots a predetermined small angle on the outer peripheral surface of the supporting member 9 around the the grommet or the eyelet 17A, which extends through the holes 15A and 16A. Such a pivoting of the inner end portion of the strip 1 is facilitated by the slidable engagement of the grommet or the eyelet 17B along the slit 16B.

Since the inner and outer end portions of the strip 1 are secured to the the supporting member 9 and the ring member 10 to allow for the end portions of the strip to be pivoted a predetermined small angle in relation to the supporting member 9 and the ring member 10 as described above, the supporting member 9 and the ring member 10 may keep their erect posture with no deviation of their longitudinal axis during the elongation of the cylindrical roll 8 from its packed up state to its fully extended state.

In the extensible cylindrical roll 8 of the abovedescribed embodiment, even if the cylindrical roll 8 is fully elongated, the pairs of lips 5A and 5B, although they are located on the outer surface of the spirally wound strip 1, would be covered by the longitudinal edge portion of the outer adjacent turn of the strip 1 or by the ring member 10, and would not be exposed on the outer surface of the umbrella cover. Since the slits 2 are located on the inner surface of the spirally wound strip, the outer peripheral surface of the extended umbrella cover would be smooth except for the helical step formed between the adjacent turns of the strip 1. This is aesthetically quite advantageous.

Although, in the above-described embodiment, the strip 1 comprises two film tapes 1A and 1B, and the slits 2 are formed in the film tape 1A on the inner surface of the spirally wound strip 1 and the pairs of lips 5A and 5B are formed in the outer film tape 1B on the outer surface of the spirally wound strip 1, it is also possible to provide the slits 2 on the outer surface and the pairs of lips 5A and 5B on the inner surface of the spirally wound strip 1. Also, the strip 1 may comprise one film tape in which both the slits 2 and the lips 5A and 5B are formed, or three or more film tapes. In the latter case, the slits 2 may be formed in the film tape on one surface of the strip 1 and the lips 5A and 5B may be formed in the film tape on the other surface of the strip 1.

The tilt angle $\alpha$ of the slit 2 may be determined in accordance with the diameter of the extensible cylindrical roll 8. It is, however, most convenient to determine the tilt angle $\alpha$ of the slit 2 such that the slit would be substantially parallel with the axis of the extended cylindrical roll 8 upon extension of the spirally wound strip 1 to its maximum length, so that the cylindrical roll 8 may be elongated without rotating the pulling end, namely, the ring member 10. It is also possible to set the tilt angle $\alpha$ to a suitable value to allow for the pulling end to rotate a predetermined angle or to undergo a predetermined number or rotations.

Figure 12:
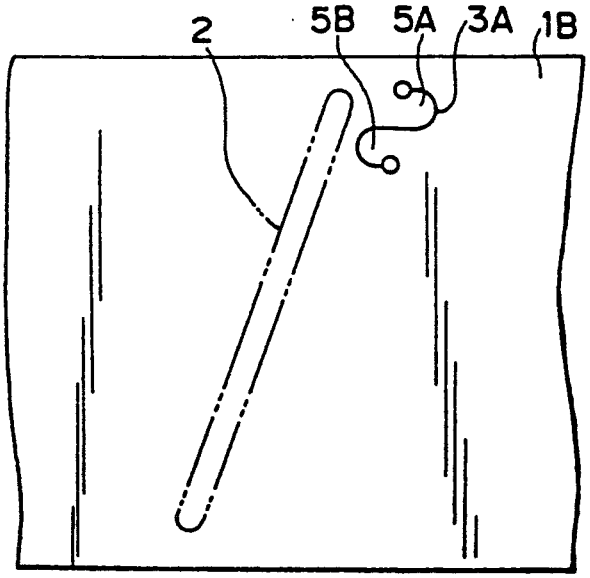
FIG. 12 is a schematic view of the strip when the extensible cylindrical roll is extended to its maximum length, presented for the purpose of explaining the tilt angle of the slit.
Figure 13:
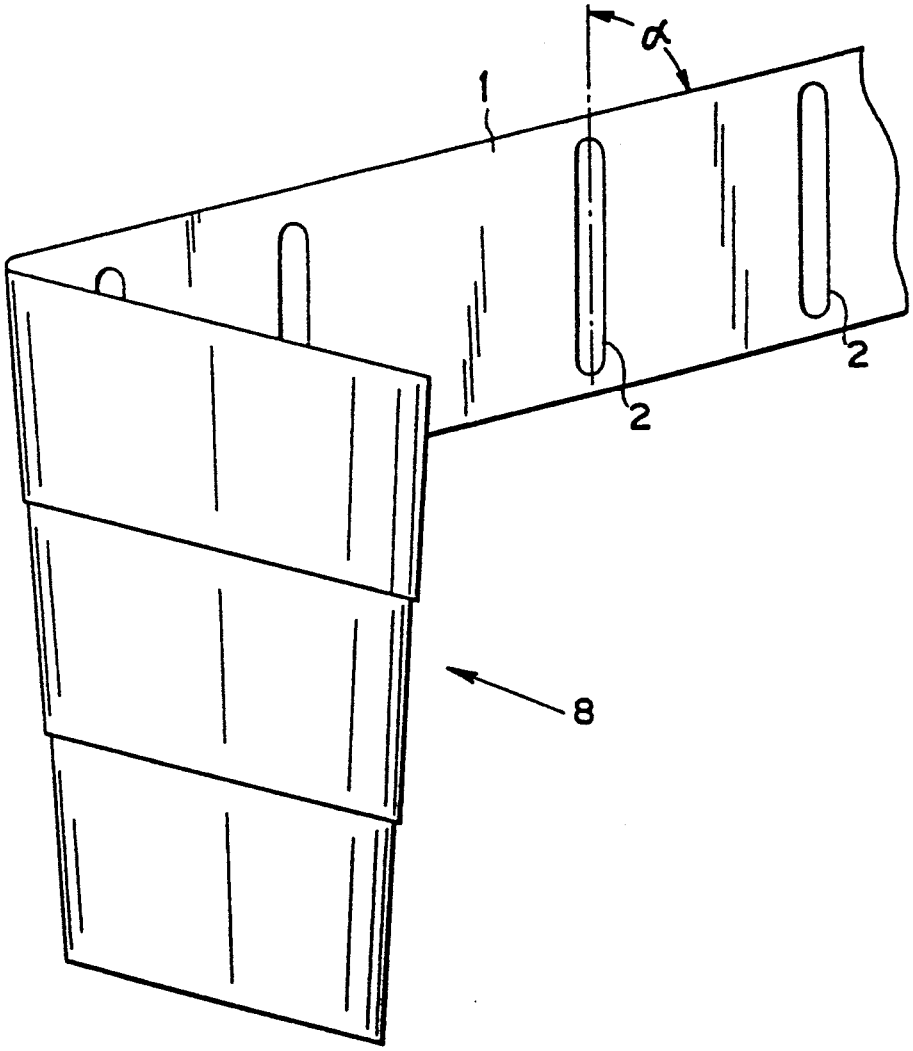
FIG. 13 is an enlarged partial plan view of the film tape of the strip according to another embodiment of the present invention wherein the lip has a different configuration from that of FIG. 2.

It is also to be noted that, although the oppositely facing lips 5A and 5B are formed independently from one another in the embodiment of FIGS. 1 to 3, they may be formed continuously by providing an S-shaped cut 3A in the film tape 1B as shown in FIG. 12.

Figure 14:
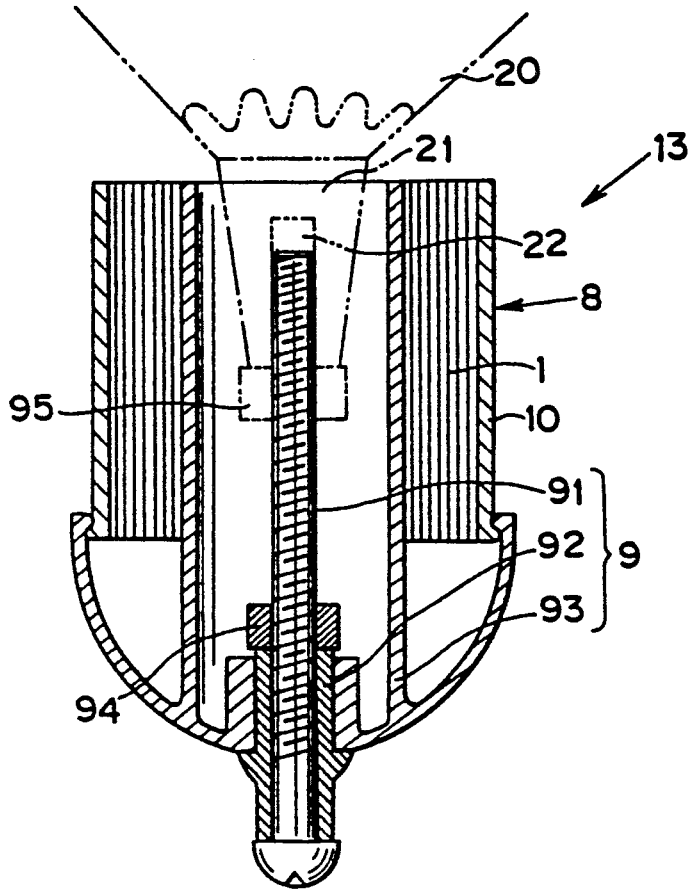
FIG. 14 is a vertical sectional view of the umbrella cover in its packed up state using the extensible cylindrical roll.
Figure 15:
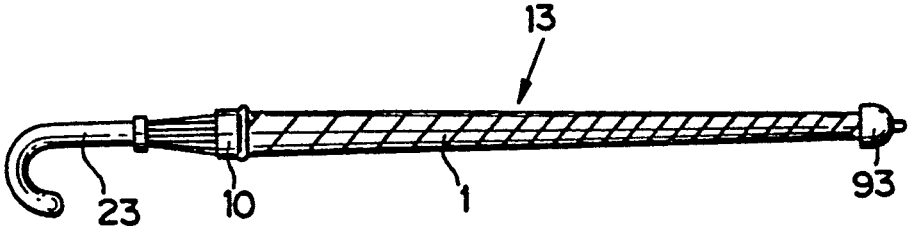
FIG. 15 is an elevational view of the umbrella cover in its pulled out elongated state.

Referring to FIG. 14, there is illustrated an embodiment of an umbrella cover 13 utilizing the extensible cylindrical roll 8 as described above.

In the embodiment shown in FIG. 14, the supporting member 9, to which the inner end portion of the spirally wound strip 1 is secured, comprises a long bolt 91 which is threaded into a tapped hole 22 formed in the ferrule 21, a ferrule sleeve 92 secured to the distal end of the long bolt 91, and a supporting sleeve 93 rotatably fitted on the ferrule sleeve 92 on its outer periphery. The inner end portion of the spirally wound strip 1 of the extensible cylindrical roll 8 is secured to the supporting sleeve 93. The supporting sleeve 93 is so constructed that one end of the ring member 10, to which the outer and portion of the spirally wound strip 1 is secured, can be removably engaged to the supporting sleeve 93.

The umbrella cover shown in FIG. 14 is assembled by passing the long bolt 91 through the ferrule sleeve 92, fitting the supporting sleeve 93 on the outer periphery of the ferrule sleeve 92, fixedly securing the ferrule sleeve 92 onto the long bolt 91 by threading a nut 94 onto the long bolt 91, threading a lock nut 95 onto the long bolt 91 to a predetermined position, and then threading the long bolt 91 into the tapped hole 22 formed in the ferrule 21.

In use, the umbrella cover 13 as described above may be secured to the ferrule 21 of the umbrella 20 with the extensible cylindrical roll 8 in its packed up state, and the ring member 10 may be pulled up along the longitudinal axis of the umbrella 20 toward the handle 23 of the umbrella 20 so that the spirally wound strip 1 of the extensible cylindrical roll 8 is helically elongated to cover the outer peripheral surface of the closed umbrella 20.

In the embodiment of FIG. 14, the supporting sleeve 93 of the supporting member 9 is rotatable around the ferrule sleeve 92 as mentioned above. Therefore, even when a force is exerted on the supporting sleeve 92 in its tangential direction due to the particular tilt angle of the slit 2 during the elongation of the spirally wound strip 1 by the pulling up of the ring member 10, the supporting sleeve 93 will rotate around the ferrule sleeve 92 and the ring member may be easily pulled up to facilitate a smooth helical elongation of the wound strip 1.

EFFECT OF THE INVENTION

As apparent from the above description, in the extensible cylindrical roll of the umbrella cover according to the present invention, the spirally wound strip can extend only to a predetermined length which is determined by the length of the slit since the pair of lips on one turn of the strip is in engagement with the slit in the adjacent turn of the strip. The strip, therefore, is prevented from becoming loose and entangled.

Furthermore, the slits and the lips may be formed by merely cutting or punching the film tapes, and therefore, may be readily and conveniently formed with a presscutting machine. Therefore, the extensible cylindrical roll, and consequently, the umbrella cover may be produced quite economically at low cost.

When the strip comprises two overlaid film tapes each having slits or lips formed therein, the strip may be so constructed that no holes or cuts penetrate throughout the thickness of the strip. In such a case, the elongated cylindrical roll may have a high liquid tightness as well as good appearance.

Still further, the umbrella cover of the present invention can smoothly and readily cover the outer peripheral surface of the umbrella by helically pulling out the spirally wound strip, and the umbrella cover in the thus elongated state has a good appearance.

I claim:

1. An umbrella cover for covering an umbrella having a ferrule comprising an extensible cylindrical roll of a spirally wound strip which may be pulled out along the axis of the cylindrical roll; wherein said spirally wound strip has an inner end portion, an outer end portion, and opposite longitudinal edges extending in the longitudinal direction of the strip;

said strip has a plurality of parallel slits formed at predetermined intervals, said slit extending at a predetermined tilt angle in relation to the longitudinal direction of the strip;

said strip has and a plurality of lips formed in the vicinity of one longitudinal edge of the strip at predetermined intervals, said lip having a configuration capable of engaging with said slit; and said strip is wound such that said lip in one turn of the spirally wound strip is slidably engaged with the slit in the adjacent turn of the wound strip so that the lip can slide along the slit in its longitudinal direction upon elongation of the cylindrical roll.

2. The umbrella cover according to claim 1, wherein said strip comprises at least two overlaid film tapes which are bonded with each other at least along their opposite longitudinal edges;

said slits being formed in the film tape on one surface of said strip; and said lips being formed in the film tape on the other surface of said strip.

3. The umbrella cover according to claim 1, wherein said strip comprises one film tape having both said slits and said lips formed therein.

4. The umbrella cover according to claim 1, wherein said inner end portion of the strip is secured to a supporting member secured to the ferrule of the umbrella; and said outer end portion of the strip is secured to a ring member coaxially positioned with the umbrella.

5. The umbrella cover according to claim 1, wherein said supporting member has a cylindrical outer surface, and said ring member has a cylindrical inner surface;

said inner end portion of the spirally wound strip is in contact with the outer surface of said supporting member, and said outer end portion of the wound strip is in contact with the inner surface of said ring member;

said extensible cylindrical roll is secured to said supporting member such that said inner end portion of the strip can pivot a predetermined small angle on the outer surface of said supporting member; and said ring member is secured to said extensible cylindrical roll such that said outer end portion of the strip can pivot a predetermined small angle on the inner surface of said ring member.

6. The umbrella cover according to claim 1, wherein said tilt angle of the slit is determined such that, upon extension of the spirally wound strip to its maximum length, the slit is substantially parallel with the axis of the extended cylindrical roll.

* * * * *